US007750611B2

(12) United States Patent
Lee

(10) Patent No.: US 7,750,611 B2
(45) Date of Patent: Jul. 6, 2010

(54) INTERNAL VOLTAGE CONTROLLERS INCLUDING MULTIPLE COMPARATORS AND RELATED SMART CARDS AND METHODS

(75) Inventor: Seung-Won Lee, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 203 days.

(21) Appl. No.: 11/951,594

(22) Filed: Dec. 6, 2007

(65) Prior Publication Data

US 2008/0143312 A1 Jun. 19, 2008

(30) Foreign Application Priority Data

Dec. 13, 2006 (KR) ..... 10-2006-0127275

(51) Int. Cl.
*G05F 1/563* (2006.01)
*G05F 1/565* (2006.01)

(52) U.S. Cl. ..... 323/274; 323/267; 323/268; 327/541

(58) Field of Classification Search ..... 323/268, 323/269, 271, 272, 281, 350, 351, 267, 273, 323/274, 314; 327/541
See application file for complete search history.

(56) References Cited

U.S. PATENT DOCUMENTS 5,512,814 A * 4/1996 Allman ..... 323/267
6,411,157 B1 6/2002 Hsu et al.

(Continued)

FOREIGN PATENT DOCUMENTS

KR 10-1999-0017145 3/1999

(Continued)

OTHER PUBLICATIONS

Korean Notice to File a Response/Amendment to the Examination Report and English Translation corresponding to Korean Application No. 10-2005-0127275 (8 pages), Mailing Date: Feb. 28, 2008.

*Primary Examiner*—Gary L Laxton
(74) *Attorney, Agent, or Firm*—Myers Bigel Sibley & Sajovec, P.A.

(57) ABSTRACT

A voltage controller may include a pulse generator and an internal voltage control circuit coupled to the pulse generator. The pulse generator may be configured to generate a control signal in response to at least one of a mode signal and/or an external voltage. The internal voltage control circuit may be configured to generate an internal voltage at an internal voltage node, and the internal voltage control circuit may include a voltage divider, first and second comparators, and a driver. The voltage divider may be coupled between the internal voltage node and a first reference voltage, and the voltage divider may generate a feedback voltage that is between the internal voltage and the first reference voltage. The first comparator may be configured to generate a first comparison result responsive to comparing the feedback voltage with a second reference voltage, and the second comparator may be configured to generate a second comparison result responsive to comparing the feedback voltage with the second reference voltage in response to the control signal. The driver may be coupled between an external voltage and the internal voltage node, and the driver may be configured to generate the internal voltage responsive to the first and second comparison results. Related methods and smart cards are also discussed.

27 Claims, 4 Drawing Sheets

U.S. PATENT DOCUMENTS

| | | | | |
|---|---|---|---|---|
| 7,362,079 | B1 * | 4/2008 | Maheedhar et al. | 323/269 |
| 2004/0052145 | A1 | 3/2004 | Sivero et al. | |
| 2005/0259497 | A1 | 11/2005 | Choi | |
| 2008/0116862 | A1 * | 5/2008 | Yang et al. | 323/269 |

FOREIGN PATENT DOCUMENTS

| | | | |
|---|---|---|---|
| KR | 10-2000-0003602 | A | 1/2000 |
| KR | 10-2001-0106892 | A | 12/2001 |
| KR | 10-2003-0055995 | A | 7/2003 |
| KR | 10-2004-0024789 | A | 3/2004 |
| KR | 10-2005-0099308 | A | 10/2005 |
| KR | 1020060040113 | A | 5/2006 |
| KR | 10-2006-0094376 | A | 8/2006 |

* cited by examiner

INTERNAL VOLTAGE CONTROLLERS INCLUDING MULTIPLE COMPARATORS AND RELATED SMART CARDS AND METHODS

RELATED APPLICATION

This U.S. non-provisional patent application claims the benefit of priority under 35 U.S.C §119 of Korean Patent Application No. 2006-127275 filed on Dec. 13, 2006, the entire disclosure of which is hereby incorporated herein by reference.

FIELD OF THE INVENTION

The present invention disclosed herein relates to voltage controllers.

BACKGROUND

Smart cards employed in mobile applications are usually equipped with internal voltage controllers by which an internal power is supplied thereto without being significantly affected by external noises or internal changes of operation modes.

In general, such smart cards for mobile applications are designed to provide low power operation. Accordingly, an internal voltage controller of a smart card may be designed to provide relatively low current operations. An operating speed of an internal voltage controller may be proportional to an amount of current consumed therein. However, such a low-power internal voltage controller may not be sufficiently quick to respond to external noise or internal changes of operation modes.

FIG. 1 is a circuit diagram showing a conventional internal voltage generator.

Referring to FIG. 1, the internal voltage controller 10 includes a comparator 11, a driver 12 and a voltage divider 13. The voltage divider 13 operates to divide an internal voltage Vint on a node N1 through resistors R1 and R2. A divided voltage Vfed (hereinafter, referred to as 'feedback voltage') is provided to the comparator 11. The comparator 11 operates to compare the feedback voltage Vfed with the reference voltage Vref. The driver 12 is controlled responsive to a result of the comparison. The driver 12 generates the internal voltage Vint from an external voltage Vext responsive to control of the comparator 11. The internal voltage Vint is provided to internal circuits 20, 30, and 40, and the internal voltage Vint is maintained at about a predetermined level by the internal voltage controller 10. The predetermined level of the internal voltage Vint is a target voltage level.

When the external voltage Vext varies due to noise or operation mode changes in the internal circuits 20, 30, and 40, the internal voltage Vint may vary. If the internal voltage Vint is reduced, the feedback voltage Vfed is reduced. The comparator 11 operates to compare the lowered feedback voltage Vfed with the reference voltage Vref, and to generate a result of the comparison. The driver 12 is turned on responsive to the result of the comparison, to supply an external current Iext to the internal circuits 20, 30, and 40, so that the internal voltage Vint increases in level. The internal voltage Vint rises until the feedback voltage Vfed is equal to the reference voltage Vref.

If the feedback voltage Vfed reaches the reference voltage Vref, the driver 12 is turned off responsive to the comparator 11, and then, the external current text to the internal circuits 20, 30, and 40 is turned off. Thus, the internal voltage Vint does not increase further. Accordingly, the internal voltage Vint is maintained at about a target voltage level using the internal voltage controller 10. When the internal voltage Vint increases above the target voltage level, the internal voltage controller 10 operates to turn off the external current Iext so that the internal voltage Vint is reduced. As a result, the internal voltage controller 10 maintains the internal voltage Vint at about the target voltage regardless of external or internal change in voltage or operation mode.

The internal voltage controller 10 is generally designed to be operable with relatively low power consumption. For that reason, the internal voltage controller 10 may not rapidly respond to variation of external noises or internal operation modes. For example, if the internal voltage Vint becomes lower in level due to variation of external noises or internal operation modes, the internal voltage controller 10 may raise the internal voltage Vint up to the target voltage level. The low-power internal voltage controller 10, however, may not operate at fast speed. Thus, while the internal voltage Vint is increasing to the target voltage level, the internal circuits 20, 30, and 40 may not operate in a normal condition because they may not be supplied with sufficient currents.

When the internal voltage Vint increases due to variation of external noises or internal operation modes, the internal voltage controller 10 reduces the internal voltage to the target voltage level. The internal voltage controller 10, however, may not operate at high speed because it is designed to be operable at low power. Thus, while the internal voltage Vint decreases to the target voltage level, the internal circuits 20, 30, and 40 may be stressed by excessive current conditions because they are supplied with too much current. Although accelerating an operation speed of the internal voltage controller 10 may reduce aforementioned problems of the internal voltage controller 10, an amount of current consumed may increase undesirably. The internal voltage controller 10 with high current consumption may be undesirable for a mobile-specific smart card.

SUMMARY

According to some embodiments of the present invention, a voltage controller may include a pulse generator and an internal voltage control circuit coupled to the pulse generator. The pulse generator may be configured to generate a control signal in response to at least one of a mode signal and/or an external voltage. The internal voltage control circuit may be configured to generate an internal voltage at an internal voltage node, and the internal voltage control circuit may include a voltage divider, first and second comparators, and a driver. The voltage divider may be coupled between the internal voltage node and a first reference voltage, and the voltage divider may generate a feedback voltage that is between the internal voltage and the first reference voltage. The first comparator may be configured to generate a first comparison result responsive to comparing the feedback voltage with a second reference voltage. The second comparator may be configured to generate a second comparison result responsive to comparing the feedback voltage with the second reference voltage in response to the control signal. The driver may be coupled between an external voltage and the internal voltage node, and the driver may be configured to generate the internal voltage responsive to the first and second comparison results.

The pulse generator may include first and second pulse generators and an OR gate. The first pulse generator may be configured to generate a first pulse signal when the mode signal changes. The second pulse generator may be configured to generate a second pulse signal when the external voltage varies. The OR gate may be configured to combine the first and second pulse signals according to a logical OR operation to thereby generate the control signal.

The first pulse generator may be configured to generate the first pulse signal when the mode signal changes from a stop mode signal to an active mode signal and/or to generate the first pulse signal when the mode signal changes from an active mode signal to a stop mode signal. The second pulse generator may be configured to generate the second pulse signal when the external voltage increases due to external noise and/or to generate the second pulse signal when the external voltage decreases due to external noise. Moreover, the first and second comparators may have a same output offset.

The internal voltage control circuit may also include a third comparator configured to generate a third comparison result responsive to comparing the feedback voltage with the second reference voltage in response to the control signal. The driver may thus be configured to generate the internal voltage responsive to the first, second, and third comparison results. Moreover, the first, second, and third comparators may have a same output offset.

According to some other embodiments of the present invention, a smart card may include a pulse generator, an internal voltage control circuit coupled to the pulse generator, and internal circuits. The pulse generator may be configured to generate a control signal in response to at least one of a mode signal and/or an external voltage. The internal voltage control circuit may be configured to generate an internal voltage at an internal voltage node, and the internal voltage control circuit may include a voltage divider, first and second comparators, and a driver. The voltage divider may be coupled between the internal voltage node and a first reference voltage, and the voltage divider may generate a feedback voltage that is between the internal voltage and the first reference voltage. The first comparator may be configured to generate a first comparison result responsive to comparing the feedback voltage with a second reference voltage. The second comparator may be configured to generate a second comparison result responsive to comparing the feedback voltage with the second reference voltage in response to the control signal. The driver may be coupled between an external voltage and the internal voltage node, and the driver may be configured to generate the internal voltage responsive to the first and second comparison results. The internal circuits may be configured to receive the internal voltage from the internal voltage node. Accordingly, the internal circuits (such as central processing unit, logic, and/or memory circuits) may operate according to the mode signal using the internal voltage.

The pulse generator may include first and second pulse generators and an OR gate. The first pulse generator may be configured to generate a first pulse signal when the mode signal changes, and the second pulse generator may be configured to generate a second pulse signal when the external voltage varies. The OR gate may be configured to combine the first and second pulse signals according to a logical OR operation to thereby generate the control signal. The first pulse generator may be configured to generate the first pulse signal when the mode signal changes from a stop mode signal to an active mode signal and/or to generate the first pulse signal when the mode signal changes from an active mode signal to a stop mode signal. The second pulse generator may be configured to generate the second pulse signal when the external voltage increases due to external noise and/or to generate the second pulse signal when the external voltage decreases due to external noise. Moreover, the first and second comparators may have a same output offset.

The internal voltage control circuit may also include a third comparator configured to generate a third comparison result responsive to comparing the feedback voltage with the second reference voltage in response to the control signal. The driver may be configured to generate the internal voltage responsive to the first, second, and third comparison results. Moreover, the first, second, and third comparators may have a same output offset.

According to still other embodiments of the present invention, a method of controlling a voltage may include generating a control signal in response to at least one of a mode signal and/or an external voltage, and generating an internal voltage at an internal voltage node. A feedback voltage may be generated that is between the internal voltage and a first reference voltage. A first comparison result may be generated responsive to comparing the feedback voltage with a second reference voltage, and a second comparison result may be generated responsive to comparing the feedback voltage with the second reference voltage in response to the control signal. The internal voltage node may be coupled with the external voltage responsive to the first and second comparison results.

Generating the control signal may include generating a first pulse signal when the mode signal changes, generating a second pulse signal when the external voltage varies, and combining the first and second pulse signals according to a logical OR operation to thereby generate the control signal. Generating the first pulse may include generating the first pulse when the mode signal changes from a stop mode signal to an active mode signal and/or when the mode signal changes from an active mode signal to a stop mode signal. Generating the second pulse may include generating the second pulse when the external voltage increases due to external noise and/or when the external voltage decreases due to external noise.

According to some embodiments of the present invention, an internal voltage controller may quickly respond to variation of an internal voltage without significantly increasing current consumption.

According to some embodiments of the present invention, an internal voltage controller may include an internal voltage control circuit that generates an internal voltage, and a pulse generator that operates to generate a control signal in response to at least one of a mode signal and an external voltage. The internal voltage control circuit may include a voltage divider, a first comparator, a second comparator, and a driver. The voltage divider may be configured to generate a feedback voltage by dividing the internal voltage. The first comparator may be configured to compare the feedback voltage with a reference voltage. The second comparator may be configured to compare the feedback voltage with the reference voltage in response to the control signal. The driver may be configured to generate the internal voltage in response to results of the first and second comparators.

The pulse generator may include a first pulse generator, a second pulse generator, and an OR gate. The first pulse generator may be configured to generate a first pulse signal if the mode signal changes. The second pulse generator may be configured to generate a second pulse signal when the external voltage varies due to external noises. The OR gate may be configured to generate at least one of the first and second pulse signals as the control signal.

The first pulse signal may be generated if the mode signal turns to an active mode from a stop mode or if the mode signal turns to a stop mode from an active mode. The second pulse signal may be generated when the external voltage increases due to external noise or when the external voltage decreases due to external noises.

The first comparator and the second comparator may be substantially the same in output offset. The internal voltage generator may further include pluralities of third comparators each comparing the feedback voltage with the reference voltage in response to the control signal. The driver may generate the internal voltage in response to results of the first and second comparators and results of the pluralities of third comparators. The first through third comparators may operate in a same output offset.

According to other embodiments of the present invention a smart card may include internal circuits, and an internal voltage controller configured to generate an internal voltage to be supplied to the internal circuits. The internal voltage generator may include an internal voltage control circuit and a pulse generator. The internal voltage control circuit may be configured to generate the internal voltage. The pulse generator may be configured to generate a control signal in response to at least one of a mode signal and an external voltage. The internal voltage control circuit may include a voltage divider, a first comparator, a second comparator, and a driver. The voltage divider may be configured to generate a feedback voltage from dividing the internal voltage. The first comparator may be configured to compare the feedback voltage with a reference voltage. The second comparator may be configured to compare the feedback voltage with the reference voltage in response to the control signal. The driver may be configured to generate the internal voltage in response to results of the first and second comparators.

The pulse generator may include a first pulse generator, a second pulse generator, and/or an OR gate. The first pulse generator may be configured to generate a first pulse signal if the mode signal changes. The second pulse generator may be configured to generate a second pulse signal when the external voltage varies due to external noises. The OR gate may be configured to generate at least one of the first and second pulse signals as the control signal.

The first pulse signal may be generated if the mode signal turns to an active mode from a stop mode or if the mode signal turns to a stop mode from an active mode. The second pulse signal may be generated when the external voltage increases due to external noise or when the external voltage decreases due to external noise. The first comparator may be substantially the same as the second comparator in output offset. The internal voltage generator may further include pluralities of third comparators each comparing the feedback voltage with the reference voltage in response to the control signal. The driver may be configured to generate the internal voltage in response to results of the first and second comparators and results of the third comparators. The first through third comparators may operate at the same output offset.

According to still other embodiments of the present invention, methods for controlling an internal voltage may be provided. The internal voltage may be generated, and a control signal may be generated in response to at least one of a mode signal and an external voltage. A feedback voltage may be generated by dividing the internal voltage, and the feedback voltage may be compared with a reference voltage. The feedback voltage may be compared with a reference voltage in response to the control signal. The internal voltage may be generated in response to comparing the feedback voltage and the reference voltage, and comparing the feedback voltage and the reference voltage in response to the control signal.

Generating the control signal may include generating a first pulse signal if the mode signal changes, generating a second pulse signal when the external voltage varies due to external noise, and outputting at least one of the first and second pulse signals as the control signal. The first pulse signal may be generated if the mode signal turns to an active mode from a stop mode, or if the mode signal turns to a stop mode from an active mode. The second pulse signal may be generated when the external voltage increases or decreases due to external noises.

Comparing the feedback voltage with the reference voltage in response to the control signal may include comparing the feedback voltage with the reference voltage in response to the control signal.

BRIEF DESCRIPTION OF THE FIGURES

Non-limiting and non-exhaustive embodiments of the present invention will be described with reference to the following figures, wherein like reference numerals refer to like parts throughout the various figures unless otherwise specified. In the figures.

DETAILED DESCRIPTION

Figure 1:
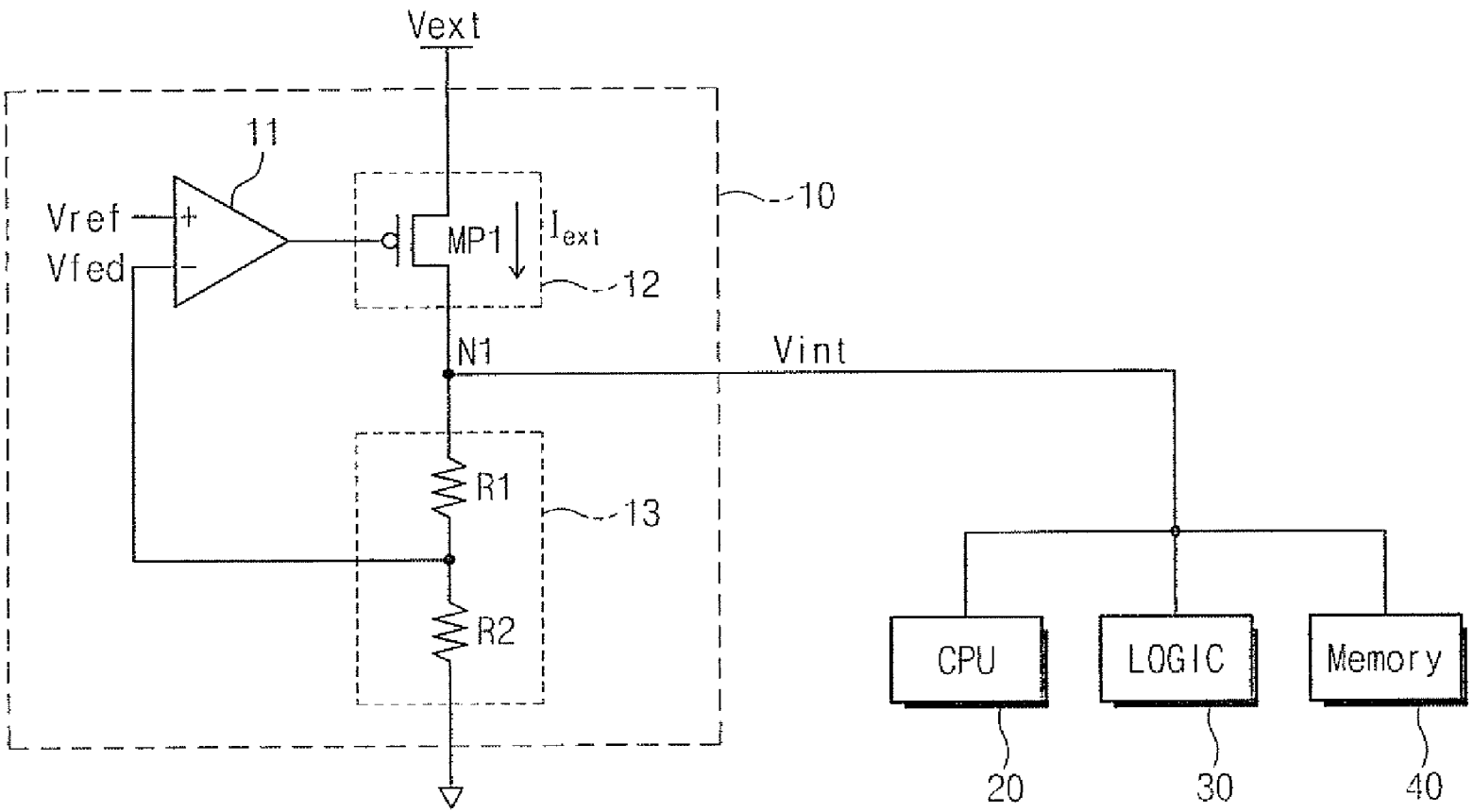
Fig. 1 (Prior Art)
FIG. 1 is a circuit diagram showing a conventional internal voltage generator.

The present invention is described more fully hereinafter with reference to the accompanying drawings, in which embodiments of the invention are shown by way of example. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. Moreover, each embodiment described and illustrated herein includes its complementary conductivity type embodiment as well.

It will be understood that when an element is referred to as being "connected to," "coupled to" or "responsive to" (and/or variants thereof) another element, it can be directly connected, coupled or responsive to the other element or intervening elements may be present. In contrast, when an element is referred to as being "directly connected to," "directly coupled to" or "directly responsive to" (and/or variants thereof) another element, there are no intervening elements present. Like numbers refer to like elements throughout. As used herein, the term "and/or" includes any and all combinations of one or more of the associated listed items and may be abbreviated as "/".

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising" (and/or variants thereof), when used in this specification, specify the presence of stated features, integers, steps, operations, elements, and/or components, but do not preclude the presence or addition of one or more other features, integers, steps, operations, elements, components, and/or groups thereof In contrast, the term "consisting of" (and/or variants thereof) when used in this specification, specifies the stated number of features, integers, steps, operations, elements, and/or components, and precludes additional features, integers, steps, operations, elements, and/or components.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present application, and will not be interpreted in an idealized or overly formal sense unless expressly so defined herein.

An internal voltage controller according to embodiments of the present invention may be able to recover an internal voltage to a target voltage without significantly increasing current consumption when an external voltage varies due to variation of operation modes and/or external noises to reduce malfunctions and/or stress of internal circuits in an electronic device such as a smart card.

Figure 2:
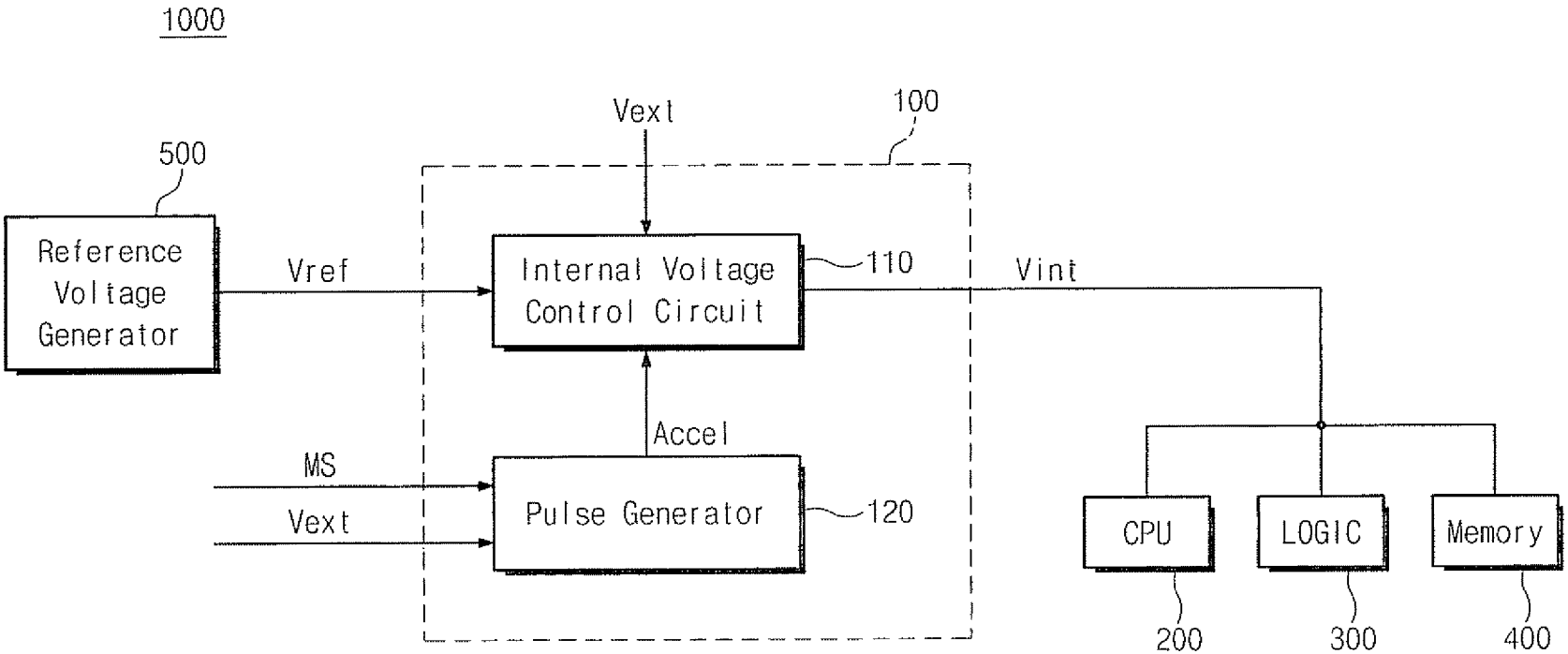
FIG. 2 is a block diagram of a smart card according to some embodiments of the present invention.

FIG. 2 is a block diagram of a smart card according to some embodiments of the present invention. Referring to FIG. 2, the smart card 1000 may include an internal voltage controller 100, a central processing unit (CPU) 200, a logic circuit 300, a memory 400, and a reference voltage generator 500. The internal voltage controller 100 may include an internal voltage control circuit 110 and a pulse generator 120.

The reference voltage generator 500 may operate to generate a reference voltage Vref. The reference voltage Vref may be provided to the internal voltage control circuit 110 of the internal voltage controller 100. The pulse generator 120 may receive a mode signal MS and an external voltage Vext, and may generate a control signal Accel in response to the mode signal MS and the external voltage Vext. The control signal Accel from the pulse generator 120 may be applied to the internal voltage control circuit 110.

If the external voltage Vext and an operation mode do not change, the pulse generator 120 may output the control signal Accel at an inactivated state. The inactivated control signal Accel may have a logic low level.

If the external voltage Vext varies due to noise and/or an operation mode change, the pulse generator 120 may output the control signal Accel at an activated state. The activated control signal Accel may have a logic high level. For example if the operation mode turns to an active mode from a stop mode, the mode signal MS input to the pulse generator 120 may change to a signal which corresponds to the active mode, from a signal corresponding to the stop mode. If the external voltage Vext increases due to external noise, the pulse generator 120 may input the external voltage Vext of high level, and the activated control signal Accel may be generated by the pulse generator 120. The activated control signal Accel may be a pulse signal.

If the external voltage Vext and the operation mode do not change, the internal voltage control circuit 110 may receive the external voltage Vext, the reference voltage Vref, and the inactivated control signal Accel. The internal voltage control circuit 110 may generate the internal voltage Vint in response to the external voltage Vext, the reference voltage Vref, and the inactivated control signal Accel. The internal voltage Vint may be supplied to the internal circuits 200, 300, and 400. The internal voltage Vint may be held at a predetermined level using the internal voltage control circuit 110. The predetermined level of the internal voltage Vint may be a target voltage level.

If the mode signal MS changes or the external voltage Vext varies due to noise, the internal voltage Vint may vary, and the predetermined level may not be maintained. Then, the internal voltage control circuit 110 may receive the external voltage Vext, the reference voltage Vref, and the activated control signal Accel, and the varied internal voltage Vint may be changed to the target voltage level in response to the external voltage Vext, the reference voltage Vref, and the activated control signal Accel. Thereby, the internal circuits 200, 300, and 400 may be supplied with the internal voltage Vint at a relatively constant level regardless of internal or external variations.

Figure 3:
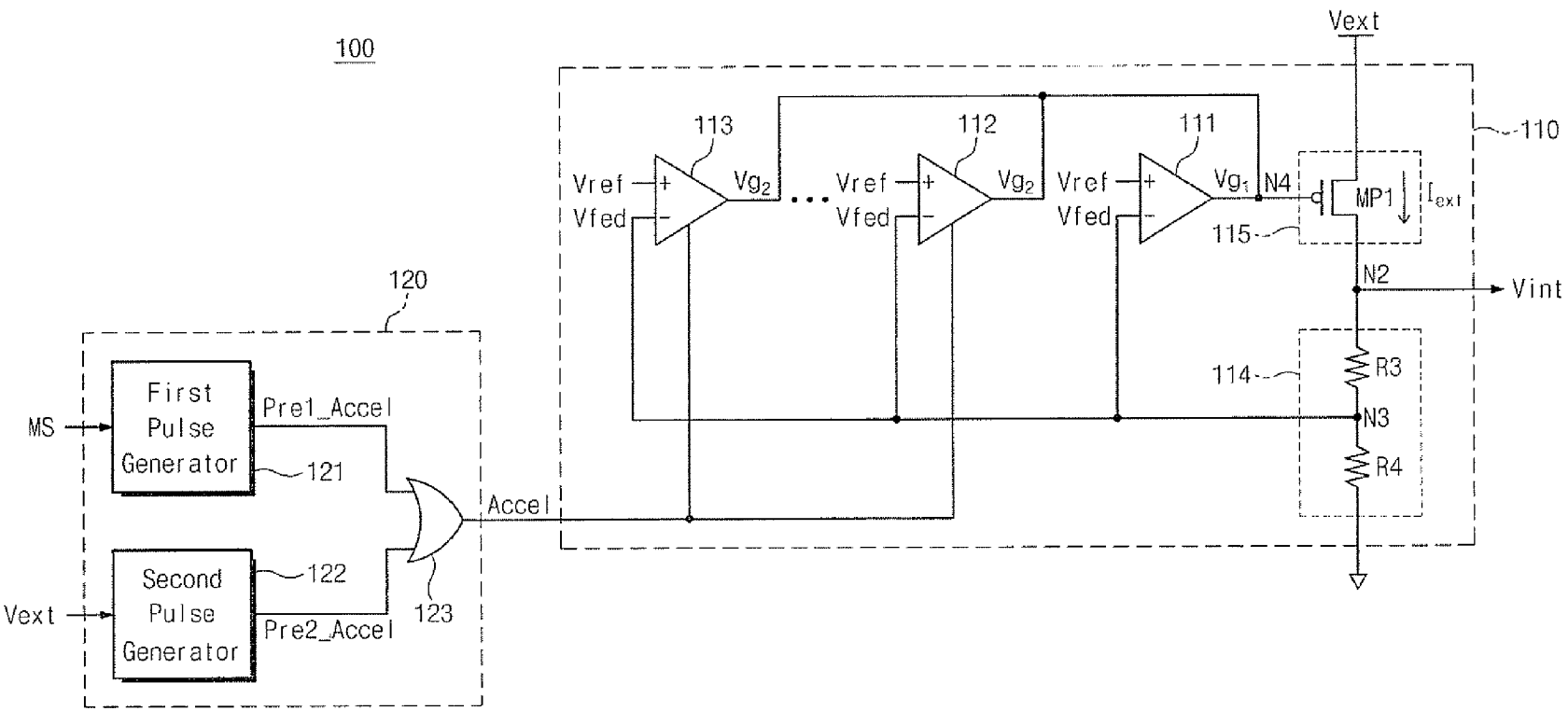
FIG. 3 is a circuit diagram illustrating an internal voltage controller shown in FIG. 2 according to some embodiments of the present invention.

FIG. 3 is a circuit diagram illustrating the internal voltage controller 100 shown in FIG. 2. Referring to FIG. 3, the internal voltage control circuit 100 may include the internal voltage control circuit 110 and pulse generator 120. The internal voltage control circuit 110 includes a first comparator 111, second comparators 112 and 113, a voltage divider (or voltage level adjuster) 114, and a driver 115. The driver 115 may include a PMOS transistor MP1 and the voltage divider 114 may include resistors R3 and R4. The first and second comparators 111 and 112/113 may operate in a same output offset. As the second comparators 112 and 113 operate according to a same pattern, operations of the first and second comparators 111 and 112 will be discussed below. Operations of the second comparators 112/113 are discussed below with respect to comparator 112.

The second comparator 112 of the internal voltage control circuit 110 may operate in response to the activated control signal Accel. The second comparator 112 may operate to compare the feedback voltage Vfed with the reference voltage Vref and may then provide a compared result Vg2 to a node N4. The first comparator 111 of the internal voltage control circuit 110 may operate to compare the feedback voltage Vfed with the reference voltage Vref and may then provide a compared result Vg1 to the node N4.

If the feedback voltage Vfed is higher than the reference voltage Vref, the driver 113 may be turned off by the compared results Vg1 and Vg2 generated by the first and second comparators 111 and 112. More particularly, the PMOS transistor MP1 of the driver 113 may be turned off in the condition of $V_{GS}$ (gate-source potential gap of the PMOS transistor MP1)$\geqq V_{TH}$ (threshold voltage of the PMOS transistor). The threshold voltage $V_{TH}$ of the PMOS transistor MP1 may have a negative value. Thus, the PMOS transistor MP1 may be turned off when the potential gap between the node N4 and the external voltage Vext is equal to or larger than the threshold voltage $V_{TH}$ of the PMOS transistor MP1. For the purpose of satisfying this condition, when the feedback voltage Vfed is higher than the reference voltage Vref, the results Vg1 and Vg2 from the first and second comparators 111 and 112 may act to raise a voltage level of the node N4. Then, the potential gap between the node N4 and the external voltage Vext becomes larger than the threshold voltage $V_{TH}$ of the PMOS transistor MP1.

If the feedback voltage Vfed is equal to the reference voltage Vref, the driver 113 may be turned off responsive to comparison results Vg1 and Vg2 output from the first and second comparators 111 and 112. More particularly, if the feedback voltage Vfed is higher than the reference voltage Vref, the first and second comparators 111 and 112 may raise a voltage level of the node N4 by means of the compared results Vg1 and Vg2, equalizing the threshold voltage $V_{TH}$ of the PMOS transistor MP1 to a potential gap between the node N4 and the external voltage Vext.

If the feedback voltage Vfed is lower than the reference voltage Vref, the driver 13 may be turned on responsive to comparison results Vg1 and Vg2 generated by the first and second comparators 111 and 112. More particularly, the PMOS transistor MP1 of the driver 113 may be turned on in the condition of $V_{GS}$ (gate-source potential gap of the PMOS transistor MP1)<$V_{TH}$ (threshold voltage of the PMOS transistor). Thus, the PMOS transistor MP1 may be turned on when the potential gap between the node N4 and the external voltage Vext is smaller than the threshold voltage $V_{TH}$ of the PMOS transistor MP1. For the purpose of satisfying this condition, when the feedback voltage Vfed is lower than the reference voltage Vref, the results Vg1 and Vg2 from the first and second comparators 111 and 112 may act to lower a voltage level of the node N4. Then, the potential gap between the node N4 and the external voltage Vext may be reduced to less than the threshold voltage $V_{TH}$ of the PMOS transistor MP1.

When the second comparator 112 is turned off in response to the inactivated control signal Accel, a voltage level of the node N4 to turn the driver 113 on or off is determined by the comparison result Vg1 of the first comparator 111.

As mentioned above, the driver 115 may be turned on or off responsive to a voltage level of the node N4. Thus, the driver 115 may provide or interrupt the external current Iext, which is induced from the external voltage Vext, to a node N2 in response to the results Vg1 and Vg2 of the first and second comparators 111 and 112, thereby setting a voltage level of the node N2. A voltage level of the node N2 may thus correspond with a level of the internal voltage Vint. The driver 115 may provide the internal voltage Vint to the voltage divider 114. In other words, the driver 115 generates the internal voltage Vint. The internal voltage Vint may be supplied to the internal circuits 200, 300, and 400, and the voltage divider 114.

The voltage divider 114 of the internal voltage control circuit 110 may generate the feedback voltage Vfed by dividing the internal voltage Vint provided from the driver 115. The feedback voltage Vfed may be applied to the first and second comparators 111 and 112. If a level of the internal voltage Vint is at the target voltage level, the feedback voltage Vfed may be equal to the reference voltage.

The PMOS transistor MP1 of the driver 115 may be supplied with the external voltage Vext through its source. A gate of the PMOS transistor MP1 may be coupled to the results Vg1 and Vg2 of the first and second comparators 111 and 112. The internal voltage Vint may be generated from a drain of the PMOS transistor MP1 at the node N2. The node N2 is connected to the resistor R3 of the voltage divider 114. The resistors R3 and R4 of the voltage divider 114 are connected in series through a node N3, and the node N3 of the voltage divider 114 is connected to inverted input terminals of the first and second comparators 111 and 112. Non-inverted input terminals of the first and second comparators 111 and 112 are connected to the reference voltage Vref.

The pulse generator 120 may include first pulse generator 121, second pulse generator 122, and OR gate 123. The first pulse generator 121 receives the mode signal MS and generates a first control signal Pre1_Accel in response to the mode signal MS. The first control signal Pre1_Accel from the first pulse generator 121 is applied to a first input terminal of the OR gate 123. The second pulse generator 122 receives the external voltage Vext and generates a second control signal Pre2_Accel in response to the external voltage Vext. The second control signal Pre2_Accel from the second pulse generator 122 is applied to a second input terminal of the OR gate 123.

The OR gate 123 receives the first and second control signals Pre1_Accel and Pre2_Accel through respective first and second input terminals. The OR gate 123 combines the control signals Pre1_Accel and Pre2_Accel using OR logic, and then outputs the control signal Accel. The control signal Accel is provided to the first comparator 111 of the internal voltage control circuit 110.

If the smart card 1000 does not change in operation mode, the first pulse generator 121 generates the first control signal Pre1_Accel, which is inactivated, in response to the mode signal MS. The inactivated first control signal Pre1_Accel is at a low logic level.

When the mode signal changes, the first pulse generator 121 may generate the first control signal Pre1_Accel, which is activated, in response to the mode signal MS. For example, if the smart card 1000 turns to the active mode from the stop mode or to the stop mode from the active mode, the mode signal MS changes to a state corresponding to the active mode from the stop mode or the other state corresponding to the stop mode from the active mode. At this time, the first pulse generator 121 may generate the activated first control signal Pre1_Accel in response to the mode signal MS. The activated first control signal Pre1_Accel is a pulse signal, which can be referred to as a first pulse signal.

If the external voltage Vext does not vary, the second pulse generator 122 outputs the second control signal Pre2_Accel, which is inactivated, in response to the external voltage Vext. The inactivated second control signal Pre2_Accel is at a low logic level.

When the external voltage Vext varies due to external noise, the second pulse generator 122 generates the second control signal Pre2_Accel, which is activated, in response to the external voltage Vext. For example, if the external voltage Vext increases or decreases due to external noise, the second pulse generator 122 may generate the activated second control signal Pre2_Accel in response to the external voltage Vext. The activated second control signal Pre2_Accel is a pulse signal, which can be referred to as a second pulse signal.

The OR gate 123 generates the control signal Accel, which is inactivated, by logically combining the inactivated first and second control signals Pre1_Accel and Pre2_Accel. The OR gate 123 generates the control signal Accel, which is activated, by logically combining the activated first and second control signals Pre1_Accel and Pre2_Accel. The inactivated control signal may be at a low logic level, while the activated control signal is a pulse signal at a high logic level.

The control signal Accel from the OR gate 123 may be provided to the second comparators 112 and 113 of the internal voltage control circuit 110.

As a result, the pulse generator 120 may operate to generate the inactivated control signal Accel if the smart card 1000 does not change in operation mode and the external voltage Vext does not vary significantly in level. Otherwise, the pulse generator 120 may operate to generate the inactivated control signal Accel if the smart card 1000 changes in operation mode and/or the external voltage Vext varies in level.

If the smart card 1000 does not change in operation mode and the external voltage Vext does not vary in level, the second comparator 122 of the internal voltage control circuit may be disabled in response to the inactivated control signal Accel generated by the pulse generator 120. In this condition, the internal voltage control circuit 110 may generate the internal voltage Vint at a same level as a target voltage. The internal voltage Vint may be supplied to the internal circuits 200, 300, and 400. The internal voltage Vint may be maintained at the predetermined level using the internal voltage control circuit 110. Operations of the internal voltage control circuit 110 are discussed below.

If the internal voltage Vint is equal to the target voltage, the feedback voltage Vfed may be summarized by Equation 1 using the resistors R3 and R4 of the voltage divider 114.

$$Vint=(Vint\times R4)/(R3+R4) \quad \text{[Equation 1]}$$

If the internal voltage Vint is equal to the target voltage in level, the reference voltage Vref input to the first comparator 111 is the same as the feedback voltage Vfed. The first comparator generates the compared result Vg1 that is provided to the driver 115 through the node N4 when the reference voltage Vref is equal to the feedback voltage Vfed. The driver 115 may be turned off in response to the comparison result Vg2 of the second comparator 112. As the external voltage Vext is interrupted by the driver 115 that is turned off, the external current Iext is not supplied to the node N2. Thus, the internal voltage may be maintained at the target voltage level.

When there is current dissipation due to activation of the internal circuits 200, 300, and/or 400, a voltage drop may occur at the node N2. Referring to Equation 1, if the internal voltage Vint is reduced in level, the feedback voltage Vfed is reduced below the reference voltage Vref. Then, the first comparator 111 provides the comparison result Vg1 to the driver 115 through the node N4 corresponding to the case that the feedback voltage Vfed is lower than the reference voltage Vref.

The driver 115 may be turned on in response to the comparison result Vg1 of the first comparator 111. As the internal voltage control circuit 110 is supplied with the external voltage Vext by the driver 115, the driver 115 supplies the external current Iext to the node N2. A voltage of the node N2 may increase by supplying the external current Iext. In response to increasing the voltage of the node N2, the internal voltage Vint also increases. When the internal voltage Vint reaches the target voltage level, the feedback voltage $V_{fed}$ will be equal to the reference voltage Vref. In this case, as discussed above, the driver 115 is turned off by the comparison result Vg1 of the first comparator 111 and the internal voltage Vint may maintain the target voltage level. By this operation of the internal voltage control circuit 110, the internal voltage controller 100 may be able to supply a relatively constant level of the internal voltage Vint to the internal circuits 200, 300, and 400.

If the mode signal MS changes and the external voltage Vext varies due to external noises, the internal voltage Vint may fluctuate, i.e., the internal voltage may not maintain a predetermined or target level. In this condition, the pulse generator 120 may generate the activated control signal Accel. The activated control signal Accel may be applied to the second comparator 112. The second comparator 112 may be enabled in response to the activated control signal Accel.

If the mode signal MS changes to the active mode from the stop mode, the internal circuits 200, 300, and/or 400 may consume more current in the active mode than in the stop mode. In this condition, as the internal circuits 200, 300, and/or 400 consume more current in the active mode, a voltage drop may occur at the node N2 so that the internal voltage Vint drops to less than the target voltage level. Thus, at the time when the mode signal turns to the active mode from the stop mode, the internal voltage Vint may be abruptly reduced.

Referring to Equation 1, when the internal voltage Vint is reduced, the feedback voltage Vfed may also be reduced. The feedback voltage Vfed is provided to the first and second comparators 111 and 112. The first and second comparators 111 and 112 receive the reference voltage Vref through the non-inverted input terminals and the feedback voltage Vfed through the inverted input terminals. Since the feedback voltage Vfed is lower than the reference voltage Vref, the first and second comparators 111 and 112 generate the compared results Vg1 and Vg2 for the driver 115 through the node N4. The driver 115 is rapidly turned on in response to the compared results Vg1 and Vg2. In detail, the PMOS transistor MP1 of the driver 115 may be turned on in the condition that a potential gap between the node N4 and the external voltage Vext is smaller than the threshold voltage $V_{TH}$ of the PMOS transistor MP1. The compared results Vg1 and Vg2 of the first and second comparators 111 and 112 may be more advantageous to determining a voltage level of the node N4, to satisfy the condition for turning on the PMOS transistor MP1, in speed than the compared result Vg1 of the first comparator 111.

Therefore, the driver 115 may be rapidly turned on in response to the compared results Vg1 and Vg2 of the first and second comparators 111 and 112. As the internal voltage control circuit 110 is supplied with the external voltage Vext by the driver 115, the driver 115 supplies the external current Iext to the node N2. A voltage of the node N2 may increase due to the supply of the external current Iext. Due to a rising of the voltage of the node N2, the internal voltage Vint also increases. If the internal voltage Vint reaches the target voltage level, as discussed above, the feedback voltage Vfed may be equal to the reference voltage Vref. Then, the driver 115 is turned off to maintain the internal voltage Vint at the target voltage level. Since the driver 115 is rapidly turned on by the comparators 111 and 112, a time to raise a level of the internal voltage Vint up to the target voltage level may be reduced.

If the mode signal MS changes to the stop mode from the active mode, the internal circuits 200, 300, and/or 400 may consume relatively small currents in the stop mode i.e., less than in the active mode. In this condition, as the internal circuits 200, 300, and 400 consume smaller currents in the stop mode, a voltage increase may occur at the node N2 that has maintained the target voltage level. Thus, at the time when the mode signal turns to the stop mode from the active mode, the internal voltage Vint may increase abruptly.

Referring to Equation 1, when the internal voltage Vint rises, the feedback voltage Vfed may also rise. The feedback voltage Vfed may be provided to the first and second comparators 111 and 112. The first and second comparators 111 and 112 may receive the reference voltage Vref through the inverted input terminals and the feedback voltage Vfed through the non-inverted input terminals. Since the feedback voltage Vfed is higher than the reference voltage Vref, the first and second comparators 111 and 112 provide the comparison results Vg1 and Vg2 to the driver 115 through the node N4. The driver 115 may be rapidly turned off in response to the comparison results Vg1 and Vg2. More particularly, the PMOS transistor MP1 of the driver 115 may be turned off in the condition that a potential gap between the node N4 and the external voltage Vext is larger than or equal to the threshold voltage $V_{TH}$ of the PMOS transistor MP1. The compared results Vg1 and Vg2 of the first and second comparators 111 and 112 may be more advantageous to determining a voltage level of the node N4, to satisfy the condition for turning the PMOS transistor MP1 off, in speed than the compared result Vg1 of the first comparator 111.

Therefore, the driver 115 may be turned off rapidly in response to the comparison results Vg1 and Vg2 of the first and second comparators 111 and 112. As the internal voltage control circuit 110 is supplied with the external voltage Vext by the driver 115, the driver 115 interrupts the external current Iext to the node N2. A voltage of the node N2 decreases due to interruption of the external current Iext. In response to a falling of the voltage at the node N2, the internal voltage Vint also decreases. If the internal voltage Vint is reduced to the target voltage level, the driver 115 maintains the internal voltage Vint at the target voltage level. Since the driver 115 is rapidly turned off by the comparators 111 and 112, a time to drop a level of the internal voltage Vint to the target voltage level may be shortened.

If the external voltage increases due to external noise, the internal voltage Vint may increase. In this condition, the driver 115 may be turned on or off.

When the driver 115 is conditioned in an off-state, a potential gap between the node N4 and the external voltage Vext may be greater than or equal to the threshold voltage $V_{TH}$ of the PMOS transistor MP1 of the driver 115. In this condition, if the external voltage Vext increases due to external noise, the potential gap between the node N4 and the external voltage Vext becomes smaller than before. If the smaller potential gap between the node N4 and the external voltage Vext is less than the threshold voltage $V_{TH}$ of the PMOS transistor MP1, the driver 115 may turn to an on-state. As the internal voltage control circuit 110 is supplied with the external voltage Vext by the driver 115, the driver 115 supplies the external current Iext to the node N2. A voltage of the node N2 increases due to the supply of the external current Iext. According to a rising of the voltage of the node N2, the internal voltage Vint may become higher than the target voltage level.

When the driver 115 is conditioned in an on-state, a potential gap between the node N4 and the external voltage Vext may be less than the threshold voltage $V_{TH}$ of the PMOS transistor MP1 of the driver 115. In this condition, if the external voltage Vext increases due to external noise, the potential gap between the node N4 and the external voltage Vext may become smaller than before. While turned on, the driver 115 supplies the external current Iext to the node N2 until the internal voltage Vint reaches the target voltage level. Since the potential gap between the node N4 and the external voltage Vext becomes smaller than before due to external noise, the on-state of the driver 115 may be maintained longer than when the external voltage Vext is applied thereto without noise. This long term of the on-state of the driver 115 may increase the external current Iext that is supplied through the node N2 by the driver 115. As the external current Iext increases, a voltage of the node N2 may increase to make the internal voltage Vint higher than the target voltage level.

As the operation of the internal voltage control circuit 100 when the internal voltage Vint increases above the target voltage level is discussed above, it will not be further explained.

If the external voltage Vext decreases due to external noise, the internal voltage Vint may be lower than the target voltage level. In this condition, the driver 115 may be conditioned in an on or off-state.

When the driver 115 is conditioned in an off-state, a potential gap between the node N4 and the external voltage Vext may be larger than the threshold voltage $V_{TH}$ of the PMOS transistor MP1 of the driver 115. In this condition, if the external voltage Vext decreases due to external noise, the potential gap between the node N4 and the external voltage Vext may become larger than before. Since the potential gap between the node N4 and the external voltage Vext becomes larger than before due to external noise, the off-state of the driver 115 may be maintained longer than when the external voltage Vext is applied thereto without noise. This long term of the off-state of the driver 115 may interrupt the external current Iext to the node N2, and may cause a deeper voltage drop at the node N2 due to current consumption of the internal circuits than when the external voltage Vext is supplied thereto without external noise. According to a reduction of the voltage of the node N2, the internal voltage Vint may become lower than the target voltage level.

When the driver 115 is conditioned in an on-state, a potential gap between the node N4 and the external voltage Vext may be smaller than the threshold voltage $V_{TH}$ of the PMOS transistor MP1 of the driver 115. In this condition, if the external voltage Vext decreases due to external noise, the potential gap between the node N4 and the external voltage Vext may become larger than before. If the larger potential gap between the node N4 and the external voltage Vext is greater than the threshold voltage $V_{TH}$ of the PMOS transistor MP1, the driver 115 turns to an off-state. As the internal voltage control circuit 110 cannot be supplied with the external voltage Vext by the driver 115, the driver 115 cannot supply the external current Iext to the node N2. A voltage of the node N2 decreases due to the interruption of the external current Iext. According to a reduction of the voltage of the node N2, the internal voltage Vint may become lower than the target voltage level.

As the operation of the internal voltage control circuit 100 in the case that the internal voltage Vint is lower than the target voltage level is discussed above, it will not be further explained.

In summary, when the mode signal MS changes or the external voltage Vext varies due to external noise, the driver 115 may be rapidly turned on or off in response to the compared results Vg1 and Vg2 of the first and second comparators 111 and 112. Thus, the internal voltage control circuit 110 may quickly recover the internal voltage Vint, which has been changed in voltage level, to the target voltage level.

While embodiments of the present invention show the internal voltage control circuit 110 operating at high speed due to the first and second comparators 111 and 112, the internal voltage control circuit 110 may include two or more units of the second comparators 112 and 113. By increasing a number of the second comparators, a speed of the internal voltage control circuit 110 may be increased.

Figure 4:
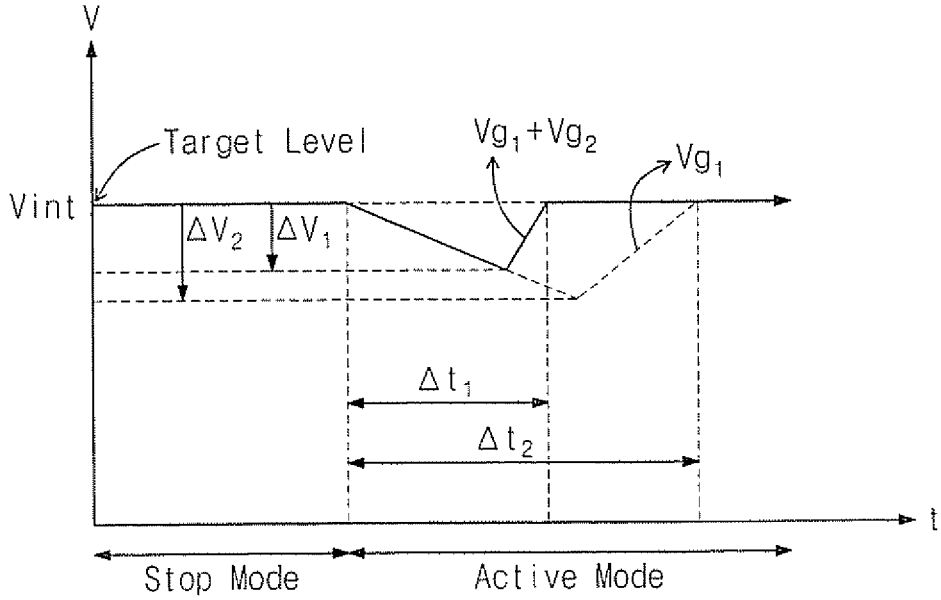
FIG. 4 is a graphic diagram illustrating characteristics of internal voltages generated from the internal voltage controller shown in FIG. 2 when a mode signal changes according to some embodiments of the present invention.
Figure 5:
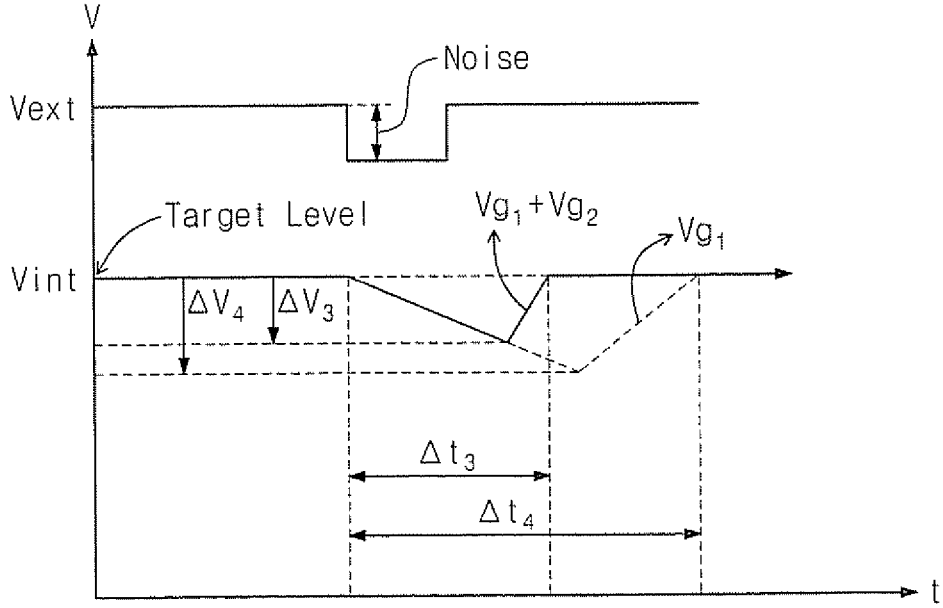
FIG. 5 is a graphic diagram illustrating characteristics of internal voltages generated from the internal voltage controller shown in FIG. 2 when an external voltage varies due to noise according to some embodiments of the present invention.

FIG. 4 is a graphic diagram showing characteristics of the internal voltage generated from the internal voltage control circuit 110 shown in FIG. 2 when the mode signal MS changes. FIG. 5 is a graphic diagram showing characteristics of the internal voltage generated from the internal voltage control circuit 110 shown in FIG. 2 when the external voltage Vext varies due to noise.

In the graphs of FIGS. 4 and 5, the plots Vg1+Vg2 depicts characteristics of the internal voltage Vint in accordance with operations of the first and second comparators 111 and 112 while changing an operation mode. The plot Vg1 corresponds to characteristics of the internal voltage Vint only when the first comparator 111 is operating. The plot Vg1 is obtained from previously discussed operations of the internal voltage controller 100.

Referring to FIG. 4, the internal voltage control circuit 110 of the internal voltage controller 100 may maintain the internal voltage Vint on the predetermined constant level in the stop mode. As can be seen from the plot Vg1+Vg2, when the stop mode turns to the active mode, the internal voltage Vint decreases in level, but the internal voltage control circuit 110 operates to rapidly recover the internal voltage Vint to the target voltage level as compared with a case using only the plot Vg1. As shown in FIG. 4, when the stop mode turns to the active mode, a voltage variation ΔV1 of the internal voltage control circuit 110 is smaller than a voltage variation ΔV2 using first comparator 11 only. Further, a time variation Δt1 of the internal voltage control circuit 110 is less than a time variation Δt2 using the first comparator 11 only.

Although not shown in FIG. 4, when the active mode turns to the stop mode, characteristic plots of the internal voltage Vint may result in a feature that the internal voltage Vint rises and recovers to the target voltage level, which is contrary to those of FIG. 4.

Referring to FIG. 5, if the external voltage Vext decreases due to external noise, the internal voltage Vint may be naturally reduced from the predetermined level (i.e., the target voltage level). Aforementioned operations of the internal voltage control circuit 110 may quickly restore the lowered internal voltage Vint to the target voltage level. As the plot Vg1+Vg2 of FIG. 5 is the same as the characteristic plot Vg1+Vg2 of FIG. 4 when the internal voltage Vint decreases due to a drop of the external voltage Vext, it will not be further described.

Although not shown in FIG. 5, when the external voltage Vext increases due to external noise, characteristic plots of the internal voltage Vint may result in a feature that the internal voltage Vint rises and recovers to the target voltage level.

As a result, even when the internal voltage Vint drops due to external noise or a change of internal operation mode, the internal voltage controller 100 may rapidly increase the internal voltage Vint to the target voltage level. Therefore, since the internal voltage controller 100 reduces a time to fit the internal voltage Vint to the target voltage level, it is able to reduce malfunctions of the internal circuits 200, 300, and 400 in the smart card 1000.

In addition, even when the internal voltage Vint rises up due to external noise or a change of internal operation mode, the internal voltage controller 100 may rapidly reduce the internal voltage Vint to the target voltage level. Since the internal voltage controller 100 reduces a time to fit the internal voltage Vint to the target voltage level, over-current stress of the internal circuits 200, 300, and 400 in the smart card 1000 may be reduced.

As described above, the internal voltage controller may rapidly respond to variation of the internal voltage, reducing malfunctions and/or stress of the internal circuits.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A voltage controller comprising:

a pulse generator configured to generate a control signal in response to at least one of a mode signal and/or an external voltage; and an internal voltage control circuit coupled to the pulse generator, wherein the internal voltage control circuit is configured to generate an internal voltage at an internal voltage node, wherein the internal voltage control circuit includes, a voltage divider coupled between the internal voltage node and a first reference voltage wherein the voltage divider generates a feedback voltage that is between the internal voltage and the first reference voltage, a first comparator configured to generate a first comparison result responsive to comparing the feedback voltage with a second reference voltage, a second comparator configured to generate a second comparison result responsive to comparing the feedback voltage with the second reference voltage in response to the control signal, and a driver coupled between an external voltage and the internal voltage node, wherein the driver is configured to generate the internal voltage responsive to the first and second comparison results.

2. The voltage controller according to claim 1 wherein the pulse generator includes, a first pulse generator configured to generate a first pulse signal when the mode signal changes, a second pulse generator configured to generate a second pulse signal when the external voltage varies, and an OR gate configured to combine the first and second pulse signals according to a logical OR operation to thereby generate the control signal.

3. The voltage controller according to claim 2 wherein the first pulse generator is configured to generate the first pulse signal when the mode signal changes from a stop mode signal to an active mode signal.

4. The voltage controller according to claim 2 wherein the first pulse generator is configured to generate the first pulse signal when the mode signal changes from an active mode signal to a stop mode signal.

5. The voltage controller according to claim 2 wherein the second pulse generator is configured to generate the second pulse signal when the external voltage increases due to external noise.

6. The voltage controller according to claim 2 wherein the second pulse generator is configured to generate the second pulse signal when the external voltage decreases due to external noise.

7. The voltage controller according to claim 1 wherein the first and second comparators have a same output offset.

8. The voltage controller according to claim 1 wherein the internal voltage control circuit further includes, a third comparator configured to generate a third comparison result responsive to comparing the feedback voltage with the second reference voltage in response to the control signal.

9. The voltage controller according to claim 8 wherein the driver is configured to generate the internal voltage responsive to the first, second, and third comparison results.

10. The voltage controller according to claim 8 wherein the first, second, and third comparators have a same output offset.

11. A smart card comprising:

a pulse generator configured to generate a control signal in response to at least one of a mode signal and/or an external voltage;

an internal voltage control circuit coupled to the pulse generator, wherein the internal voltage control circuit is configured to generate an internal voltage at an internal voltage node, wherein the internal voltage control circuit includes, a voltage divider coupled between the internal voltage node and a first reference voltage wherein the voltage divider generates a feedback voltage that is between the internal voltage and the first reference voltage, a first comparator configured to generate a first comparison result responsive to comparing the feedback voltage with a second reference voltage, a second comparator configured to generate a second comparison result responsive to comparing the feedback voltage with the second reference voltage in response to the control signal, and a driver coupled between an external voltage and the internal voltage node, wherein the driver is configured to generate the internal voltage responsive to the first and second comparison results; and internal circuits configured to receive the internal voltage from the internal voltage node.

12. The smart card according to claim 11 wherein the pulse generator includes, a first pulse generator configured to generate a first pulse signal when the mode signal changes, a second pulse generator configured to generate a second pulse signal when the external voltage varies, and an OR gate configured to combine the first and second pulse signals according to a logical OR operation to thereby generate the control signal.

13. The smart card according to claim 12 wherein the first pulse generator is configured to generate the first pulse signal when the mode signal changes from a stop mode signal to an active mode signal.

14. The smart card according to claim 12 wherein the first pulse generator is configured to generate the first pulse signal when the mode signal changes from an active mode signal to a stop mode signal.

15. The smart card according to claim 12 wherein the second pulse generator is configured to generate the second pulse signal when the external voltage increases due to external noise.

16. The smart card according to claim 12 wherein the second pulse generator is configured to generate the second pulse signal when the external voltage decreases due to external noise.

17. The smart card according to claim 11 wherein the first and second comparators have a same output offset.

18. The smart card according to claim 11 wherein the internal voltage control circuit further includes, a third comparator configured to generate a third comparison result responsive to comparing the feedback voltage with the second reference voltage in response to the control signal.

19. The smart card according to claim 18 wherein the driver is configured to generate the internal voltage responsive to the first, second, and third comparison results.

20. The smart card according to claim 18 wherein the first, second, and third comparators have a same output offset.

21. A method of controlling a voltage, the method comprising:

generating a control signal in response to at least one of a mode signal and/or an external voltage;

generating an internal voltage at an internal voltage node;

generating a feedback voltage that is between the internal voltage and a first reference voltage, generating a first comparison result responsive to comparing the feedback voltage with a second reference voltage, generating a second comparison result responsive to comparing the feedback voltage with the second reference voltage in response to the control signal, and coupling the internal voltage node with the external voltage responsive to the first and second comparison results.

22. The method according to claim 21 wherein generating the control signal includes, generating a first pulse signal when the mode signal changes, generating a second pulse signal when the external voltage varies, and combining the first and second pulse signals are combined according to a logical OR operation to thereby generate the control signal.

23. The method according to claim 22 wherein generating the first pulse comprises generating the first pulse when the mode signal changes from a stop mode signal to an active mode signal and/or when the mode signal changes from an active mode signal to a stop mode signal.

24. The method according to claim 22 wherein generating the second pulse comprises generating the second pulse when the external voltage increases due to external noise and/or when the external voltage decreases due to external noise.

25. A voltage controller according to claim 1 wherein the pulse generator includes, a first pulse generator configured to generate a first pulse signal when the mode signal changes, a second pulse generator configured to generate a second pulse signal when the external voltage varies, and a logic gate configured to combine the first and second pulse signals to thereby generate the control signal.

26. A smart card according to claim 11 wherein the pulse generator includes, a first pulse generator configured to generate a first pulse signal when the mode signal changes, a second pulse generator configured to generate a second pulse signal when the external voltage varies, and a logic gate configured to combine the first and second pulse signals to thereby generate the control signal.

27. A method according to claim 21 wherein generating the control signal includes, generating a first pulse signal when the mode signal changes, generating a second pulse signal when the external voltage varies, and combining the first and second pulse signals to thereby generate the control signal.

* * * * *

UNITED STATES PATENT AND TRADEMARK OFFICE

CERTIFICATE OF CORRECTION

PATENT NO. : 7,750,611 B2
APPLICATION NO. : 11/951594
DATED : July 6, 2010
INVENTOR(S) : Lee It is certified that error appears in the above-identified patent and that said Letters Patent is hereby corrected as shown below:

Column 1, Line 65: Please correct "current text" to read -- current Iext --

Signed and Sealed this

Seventh Day of December, 2010

David J. Kappos

David J. Kappos
*Director of the United States Patent and Trademark Office*